US008370992B2

(12) United States Patent
Chong et al.

(10) Patent No.: US 8,370,992 B2
(45) Date of Patent: Feb. 12, 2013

(54) VACUUM CLEANER

(75) Inventors: Chung Ook Chong, Gwangmyeong-si (KR); Kie Tak Hyun, Seoul (KR)

(73) Assignee: LG Electronics Inc., Seoul (KR)

( * ) Notice: Subject to any disclaimer, the term of this patent is extended or adjusted under 35 U.S.C. 154(b) by 322 days.

(21) Appl. No.: 12/915,082

(22) Filed: Oct. 29, 2010

(65) Prior Publication Data

US 2011/0099749 A1 May 5, 2011

Related U.S. Application Data

(60) Provisional application No. 61/257,027, filed on Nov. 1, 2009.

(51) Int. Cl.
*A47L 9/10* (2006.01)

(52) U.S. Cl. ..... 15/352; 15/320; 55/DIG. 3

(58) Field of Classification Search ..... 15/347–353, 15/320; 55/DIG. 3; *A47L 9/10*
See application file for complete search history.

(56) References Cited

U.S. PATENT DOCUMENTS

| | | | | |
|---|---|---|---|---|
| 7,600,293 | B2 * | 10/2009 | Lee et al. | 15/352 |
| 7,611,558 | B2 * | 11/2009 | Oh et al. | 55/432 |
| 7,770,253 | B2 * | 8/2010 | Ha et al. | 15/319 |
| 7,992,253 | B2 * | 8/2011 | Yun et al. | 15/352 |
| 2009/0241286 | A1 * | 10/2009 | Hwang et al. | 15/347 |
| 2009/0255083 | A1 * | 10/2009 | Hwang et al. | 15/347 |

* cited by examiner

*Primary Examiner* — David Redding
(74) *Attorney, Agent, or Firm* — Birch, Stewart, Kolasch & Birch, LLP

(57) ABSTRACT

A vacuum cleaner is disclosed. The present invention relates to a vacuum cleaner that is able to form dust and foreign substances collected in a dust collection device provided therein in a single mass shape to discharge it efficiently, not scattered in a dust collecting device. The vacuum cleaner includes a body, a dust collection device collecting dust and foreign substances therein, a compression device provided in the dust collection device to collect the dust and foreign substances collected in a predetermined portion of the dust collection device and to compress the collected dust and foreign substances, and a liquid supply device arranged in the dust collection device, in communication with an inside of the dust collection device, to supply liquid material to the dust collection device.

10 Claims, 10 Drawing Sheets

(a)

(b)

VACUUM CLEANER

Pursuant to 35 U.S.C. §119(a), this application claims the benefit of earlier filing date and right of priority to U.S. Provisional patent Application No. 61/257,027, filed on Nov. 1, 2009, the contents of which are hereby incorporated by reference herein in their entirety.

BACKGROUND OF THE INVENTION

1. Field of the Invention

The present invention relates to a vacuum cleaner, more specifically, to a vacuum cleaner that is able to form dust and foreign substances collected in a dust collection device provided therein in a single mass shape to discharge it efficiently, not scattered in a dust collecting device.

2. Discussion of the Related Art

Generally, vacuum cleaners are electric appliances that are able to remove dust and foreign substances placed on floors or furniture of buildings via a mechanism that sucks external air by using a vacuum pressure.

Such a vacuum cleaner may be categorized into a canister type and an up-right type. In a canister type vacuum cleaner, a body and a suction nozzle are independently connected to a predetermine pipe. In an up-right type, the body and the suction nozzle are integrally provided.

The conventional vacuum cleaner typically includes a suction nozzle, a dust separation device, a dust collection device, a vacuum motor and a filter. Here, the dust separation device separates air and foreign substances sucked by the suction nozzle by using a cyclone theory. The dust collection device is connected to a foreign substance outlet of the dust separation device and it collects dust and other foreign substances. The vacuum motor is connected to an air outlet of the dust separation device and it forms a vacuum pressure. The filter is connected to an outlet of the vacuum pump and it filters air exhausted outside.

When the user starts the vacuum cleaner having the above configuration, air and foreign substance having passed the suction nozzle are rotating in the dust separation device. Some of the foreign substances having a large mass are rotated along an inner circumferential surface of the dust separation device by a centrifugal force thereof, only to be drawn into the dust collection device.

The purified air is exhausted outside via the motor and the filter.

However, if dust and other foreign substances accumulate in the dust collection device according to the conventional vacuum cleaner, their light mass would make the dust and other foreign substances scattered in the dust collection device. In addition, if the user takes out the dust collection device only to throw the dust substances out, the dust substances would be scattered.

SUMMARY OF THE INVENTION

To solve the problems, an object of the present invention is to provide a vacuum cleaner that is able to make dust and other foreign substances collected in a dust collection device into a mass having a predetermined size, without scattering.

Furthermore, another object of the present invention is to provide a vacuum cleaner that is able to collect and to throw out dust and other foreign substances efficiently without scattering.

To achieve these objects and other advantages and in accordance with the purpose of the invention, as embodied and broadly described herein, a vacuum cleaner includes a body; a dust collection device collecting dust and foreign substances therein; a compression device provided in the dust collection device, the compression device collecting the dust and foreign substances collected in a predetermined portion of the dust collection device and compressing the collected dust and foreign substances; and a liquid supply device arranged in the dust collection device, in communication with an inside of the dust collection device, to supply liquid material to the dust collection device.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

DETAILED DESCRIPTION OF THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 1:
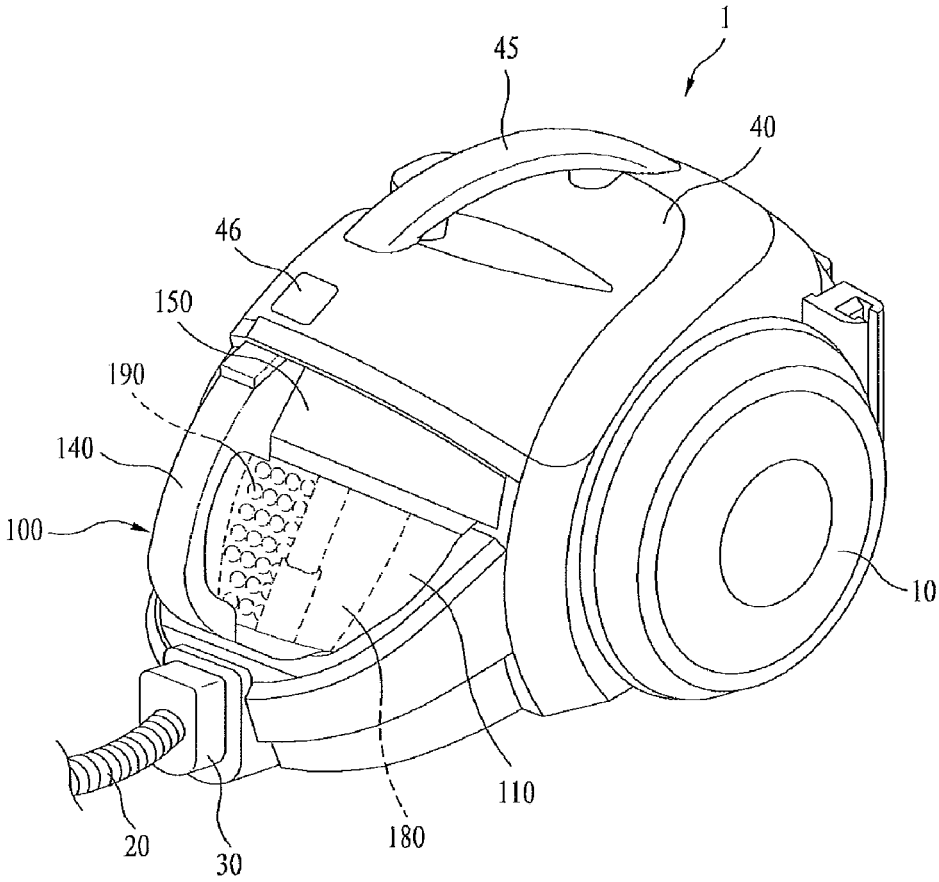
FIG. 1 is a perspective view illustrating a vacuum cleaner according to an exemplary embodiment of the present invention.

As shown in FIG. 1, a vacuum cleaner according to an exemplary embodiment of the present invention includes a body 1, a suction part 30, and wheels 10. The suction part 30 provided in a front portion of the body 1 and a connection tube 20 connected to a suction nozzle (not shown) is provided in the suction part 30. The wheel 10 is provided in each side of the body 1 to allow the body 1 to move smoothly.

A cover member 40 is provided in a top of the body 1 to protect inner configurations and a handle 45 is provided on the cover member 40 for a user to grab efficiently.

A securing member 46 is provided on a front portion of the cover member 40 and the securing member 46 is combined of a button and a latch to secure the cover member 40 to the body 1 detachably.

A dust collection device 100 is provided in a front portion of the body and the dust collection device 100 collects dust and other foreign substances. Here, the dust collection device 100 may be formed of transparent material such that the collected dust and other foreign substances may be visible from outside.

The dust collection device 100 includes a dust collecting box 110 for collecting the dust and other foreign substances therein, a handle 140 secured to the dust collecting box 110 and a dust collecting box cover 150 for covering a top of the dust collecting box 110.

A fixed plate 180 and a rotating plate 190 are provided in the dust collecting box 110 to compress the dust and other foreign substances.

Figure 2:
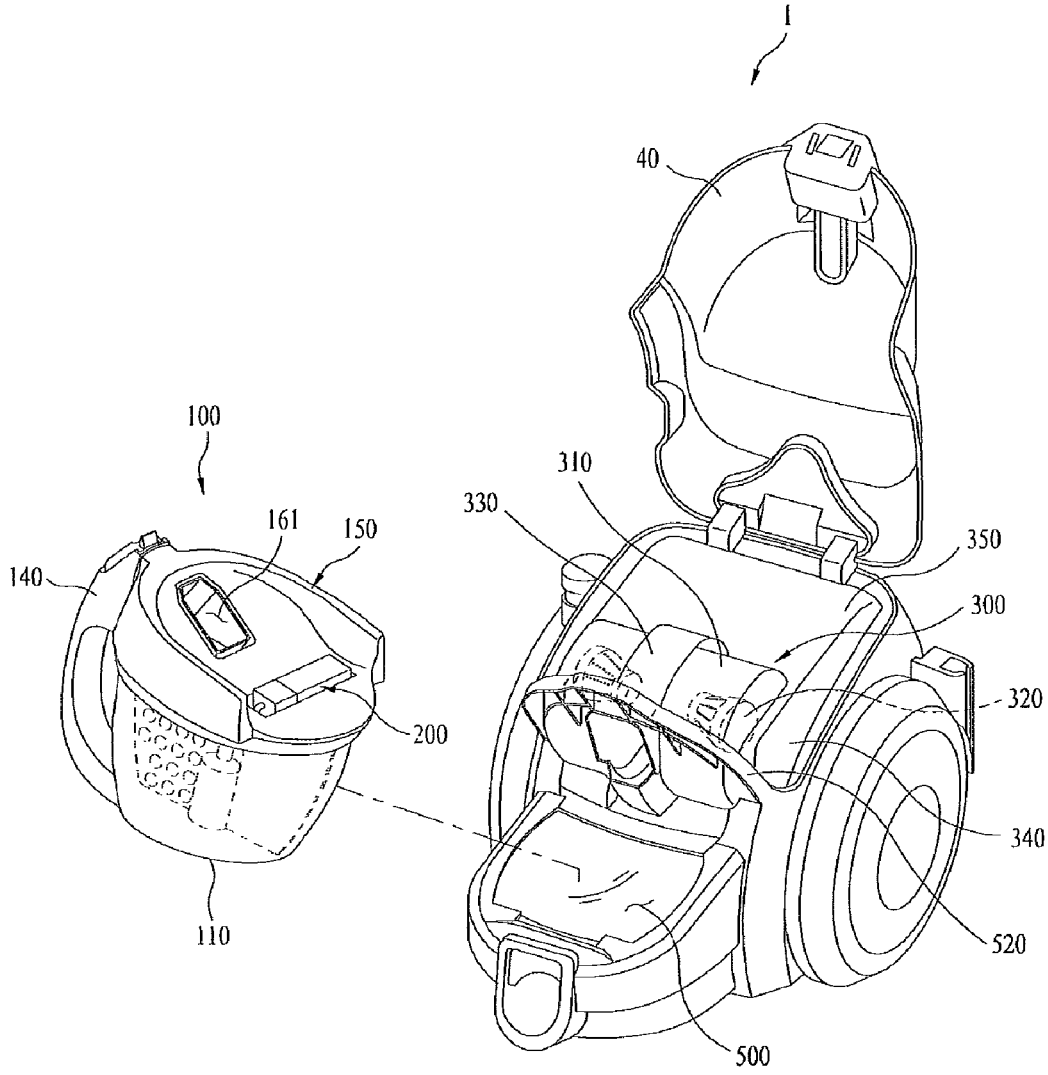
FIG. 2 is an exploded perspective view illustrating a body of the vacuum cleaner according to the exemplary embodiment of the present invention.

As shown in FIG. 2, a dust separation device 300 is provided in the body 1 to separate dust and air. The dust separation device 300 may include a dust bag used as a filter or it may be embodied as dust separation unit.

According to this embodiment, the dust separation device 300 may be embodied as dust separation unit and the present invention is not limited thereto. Any products capable of separating dust and air may be applicable to the present invention.

Here, the separation device 300 may include a body part 310 having a cylindrical shape, air outlet members 320 provided in both side portions inside the body part 310, with a plurality of through holes, and an outlet part 330 provided in a center of the body part 310 to exhaust the dust separated from the air.

An inlet part (not shown) is provided in a lower portion of the body part 310 to suck external air and dust therein and an air guiding part 340 provided in both side portions of the body part 310 to guide the motion of the air having passed the air outlet members 320.

Here, a first filtering unit 350 is provided in rear of the body part 310 to filter the air discharged from the body part 310 and the first filtering unit 350 is connected to the body part 310 by the air guide part 340.

A motor unit (360, see FIG. 9) is provided below the dust separation device 300 and the motor unit forms a vacuum pressure to suck air. The motor unit 360 is connected to the first filtering unit 350 and it discharges the air outside the body 1 after sucking the air having passed the first filtering unit 350.

A dust collection device accommodating part 500 is provided in a front portion of the body 1 and the dust collection device accommodating part 500 partially accommodates the dust collection device 100. The dust collection device accommodating part 500 is formed in a hemisphere shape and the dust collection device 100 is detachably accommodated in the dust collection device accommodating part 500.

A connection plate 520 is provided between the dust separation device 300 and the dust collection device 100 and the handle 140 of the dust collection device 100 is detachably connected to a lower surface of the connection plate 520.

A front portion of the cover member 40 is detachably connected to an upper surface of the connection plate 520.

Also, an end of an outlet part 330 of the dust separation device 300 is connected to the connection plate 520 and an inlet 161 of the dust collection device 140 is connected to the connection plate 520.

As a result, the dust and other foreign substances rotating within the dust separation device 300 are moved along the outlet part 330 by a centrifugal force thereof, only to be sucked into the inlet 161 of the dust collection device 100. After that, the dust and other foreign substances are collected in the dust box 110.

To prevent the dust and other foreign substances collected in the dust collecting box 110 from being scatterable easily, a liquid supply device 200 is on an upper surface of the dust collecting box cover 150 and the liquid supply device 200 supplies predetermined liquid material to the dust collecting box 110.

Here, the liquid material may be configured of liquid having predetermined viscosity and this viscosity makes the dust and other foreign substances attached to each other such that the dust and other foreign substances may form a mass having a predetermined weight.

The liquid supply device 200 and the dust collection device compose a single dust collection assembly that is able to embody collection and compression of the dust and other foreign substances and to perform solidification by using the mixture of liquid sequentially.

Figure 3:
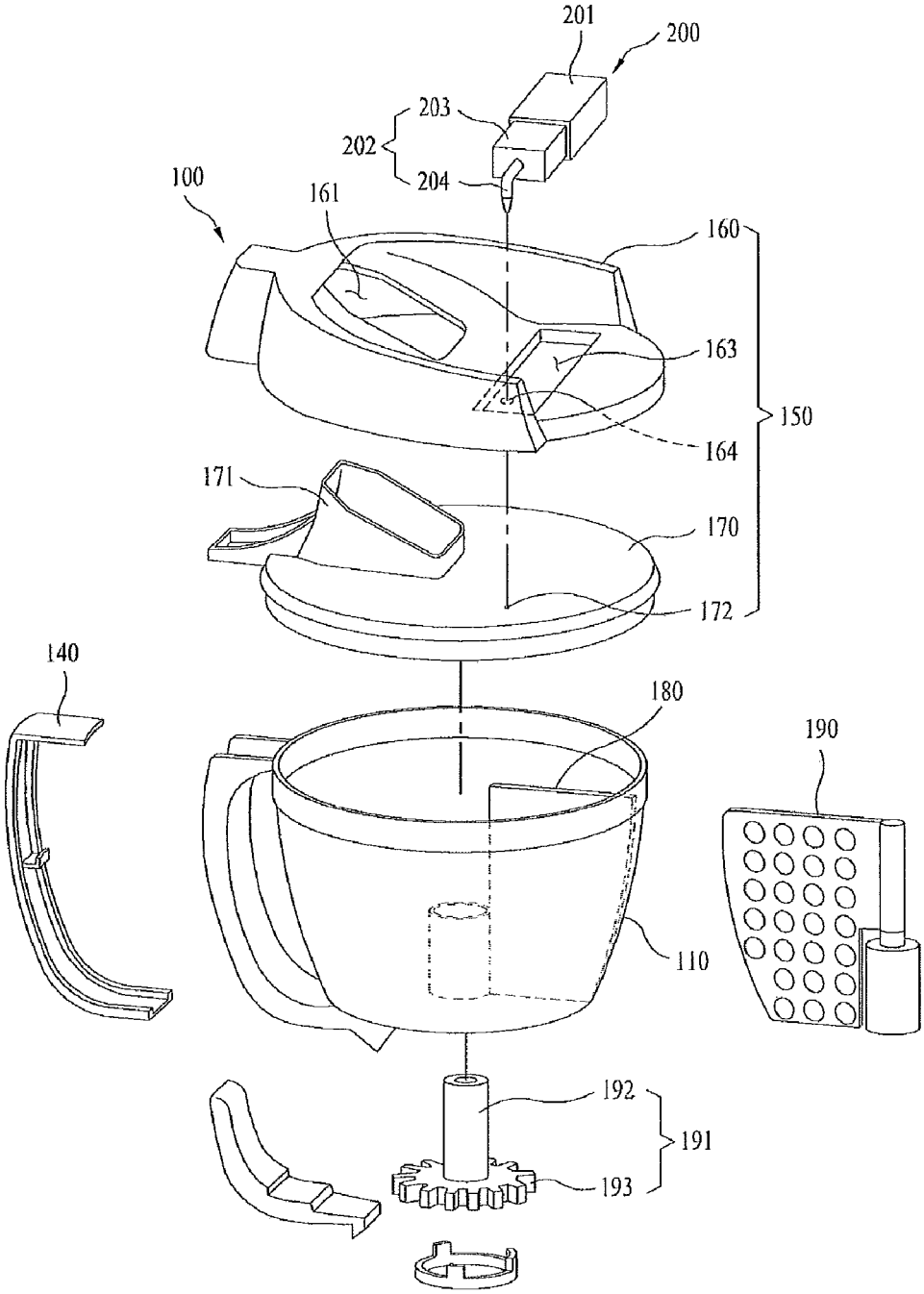
FIGS. 3 to 5 are perspective views illustrating a liquid supply part provided beyond a dust collection device of the vacuum cleaner.

As shown in FIG. 3, the dust collection device 100 includes the dust collecting box 110 for collecting dust and other foreign substances therein and the dust collecting box cover 150 for opening and closing a top of the dust collecting box 110.

Here, the dust collecting box cover 150 includes an external dust collecting box cover 160 and an inner dust collecting box cover 170.

The inlet 161 is provided in the external dust collecting box cover 160 to suck dust and other foreign substances therein and a securing groove 163 is provided in the external dust collecting box cover 160 to install the liquid supply device therein. As mentioned above, the liquid supply device supplies the liquid material.

The liquid supply device 200 installed in the securing groove 163 includes a storage part 210 having a box shape to store the liquid material therein and a guiding member 202 connected to the storage part 201 to guide the liquid material stored in the storage part 210 toward the dust collecting box 110.

The guiding member 202 includes an outlet pump 203 for exhausting the liquid material in a predetermined time interval during the operation of the vacuum cleaner and a guide tube 204 connected to the exhaustion pump 203 to guide the liquid material exhausted from the exhaustion pump 203 into the dust collecting box 110.

The guiding tub 204 is extended to the inside of the dust collecting box 110, passing through the external dust collecting box cover 160 and the inner dust collecting box cover 170 and it discharges the liquid material from an upper portion of the dust collecting box 110 downward.

It is preferable to spray the liquid material discharged from the guiding tub 204 that a diameter of an end of the guiding tube 204 is substantially smaller than a diameter of the other portions of the guiding tub 204.

In the meanwhile, at least one outlet 164 and 172 may be formed in the dust collecting box cover 150.

If the dust collecting box cover 150 is configured of the external and internal dust collecting box covers 160 and 170 as mentioned above, the securing groove 163 and the first outlet 164 are provided in the external dust collecting box cover 160 and the second outlet 172 is provided in the internal dust collecting box cover 170.

The guiding tube 204 is inserted in the first and second outlets 164 and 172 to spray the liquid material into the dust collecting box 110.

The inlet 161 connected to the connection plate (520, see FIG. 2) is provided in the external dust collecting box cover 160 and the dust and other foreign substances exhausted from the dust separation device are sucked into the inlet 161.

An inlet guiding tube 171 connected to the inlet 161 is provided in the internal dust collecting box cover 170 and the inlet guiding tube 171 guides the dust and other foreign substances toward the inside of the dust collecting box 110.

The handle 140 is provided in a predetermined portion of an outer surface of the dust collecting box 110 such that the user may hold the dust collecting box smoothly.

A compression device is provided in the dust collecting box 110 and the compression device compresses and collects the dust and other foreign substances. Such the compression device includes a rotating plate 190 rotatably provided in the dust collecting box 110 and a fixed plate 180 fixed in the dust collecting box 110 to contact with the rotating plate 190.

A driving part 191 is provided below the dust collecting box 110 and the driving unit 191 rotates the rotating plate 190. The driving part 191 includes a rotation shaft 192 inserted in a lower portion of the rotating plate 190 and a driving gear 193 connected to the rotation shaft 192.

The driving gear 193 is rotated by operation of a driving motor (not shown) provided in the body 1 and the rotating plate 190 is rotated by the rotation of the driving gear 193. Here, the rotating plate 190 contacts with the fixed plate 180 during the rotation.

The driving motor (not shown) may be configured of a step motor. As a result, the rotating plate 190 is moved along a predetermined direction toward a surface of the fixed late 180 by the driving of the driving motor (not shown).

If the rotating plate 190 contacts with the fixed plate 180 or it is not moved along the predetermined direction with respect to the surface of the fixed plate 180 any further, the rotating plate 190 moves along another direction toward the other surface of the fixed plate 180.

Such the motion makes the dust and other foreign substances collected near both surfaces of the fixed plate 180 and the liquid material exhausted from the liquid supply device 200 is sprayed toward the collected dust and other foreign substances such that the dust and other foreign substances may be solidified to be a mass having a predetermined size and weight.

Here, the exhaustion pump 203 is configured of an electronic pump and if dust and other foreign substances are collected during the operation of the vacuum cleaner, the exhaustion pump 203 may operate periodically and the liquid material may be sprayed into the dust collecting box 110 periodically.

Alternatively, the exhaustion pump 203 may be a manual pump. The user takes out the dust collecting device 100 from the body and he/she starts the exhaustion pump 203 to spray the liquid material toward the dust and other foreign substances.

Figure 4:
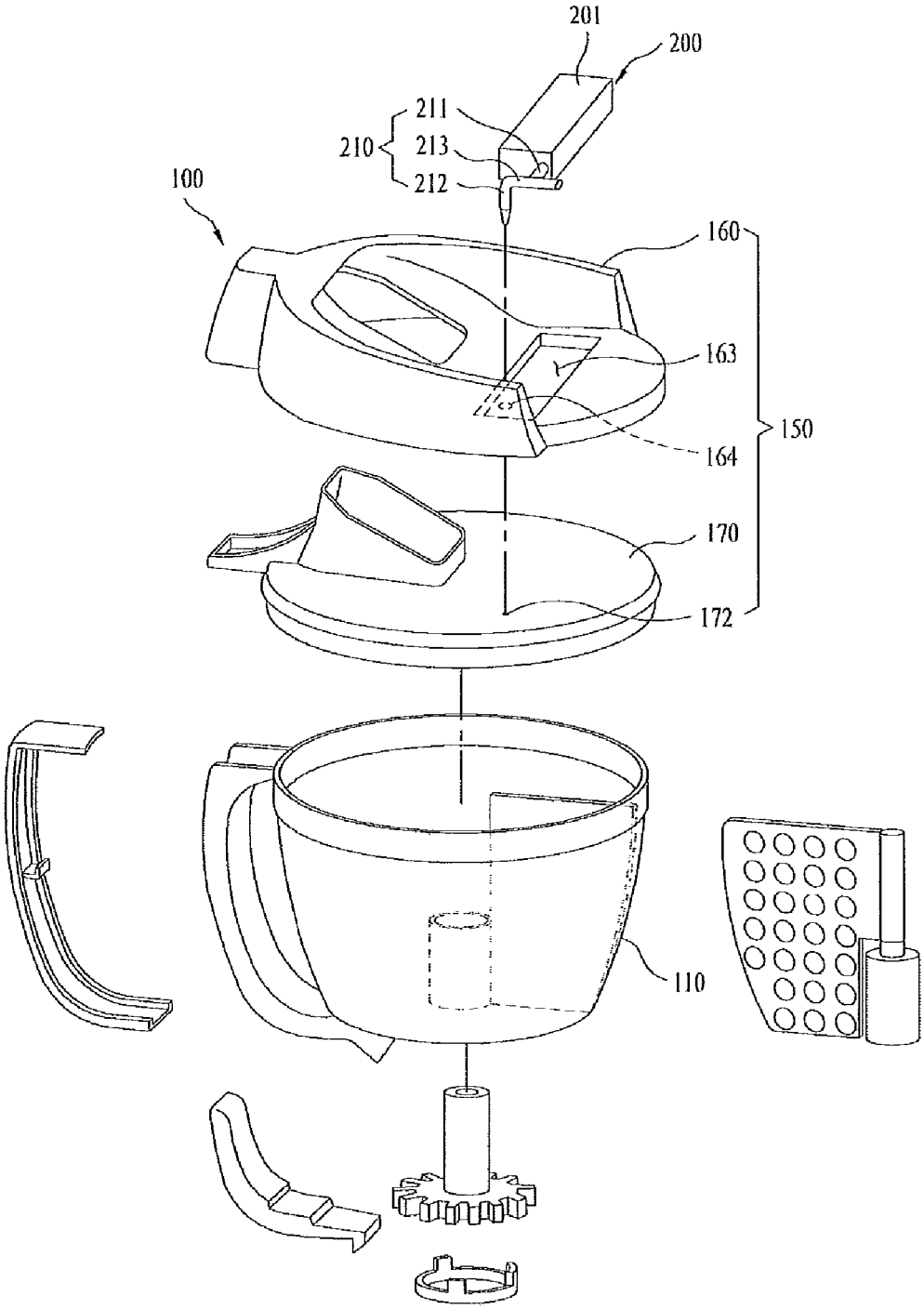

FIG. 4 illustrates the liquid supply device configured of the storage part 201 for storing the liquid material therein and the guiding tube 210 connected to the storage part 201.

If pressure gradients are generated between the inside and outside of the dust collecting box 110 only to flow air from the outside to the inside of the dust collecting box 110, the fast air flux sucks the liquid material stored in the storage part 201 toward the dust collecting box 110 via the guiding tube 210.

The guiding tube 210 may be divided in three ways.

That is, the guiding tube 210 includes a first guiding tube 211 in communication with the storage part 201, a second guiding tube 212 connected to the first guiding tube 211 through the dust collecting cover 150 and a third guiding tube 213 connected to the first and second guiding tubes 211 and 212, having an end open toward the outside of the dust collecting box 110.

As a result, when the vacuum cleaner according to the present invention is put into operation, the air exhausted from the dust separation device (300, see FIG. 2) together with the foreign substances to be sucked into the dust collecting box 110 fast may form a pressure lower than an atmosphere pressure outside in the dust collecting box 110.

Because of that, external air is exhausted into the dust collecting box 110 along the second and third guiding tubes 212 and 213. At this time, the pressure inside the second and third guiding tubes 212 and 213 is formed lower than the pressure inside the storage part 201 by the air that flows along the second and third guiding tubes 212 and 213 fast.

As a result, the liquid material contained in the storage part 201 may flow toward a connection part between the second and third guiding tubes 212 and 213 along the first guiding tube 211 and then the moved liquid material is discharged into the dust collecting box 110 along the air flow such that it may fall to the dust and other foreign substances to be solidified.

For the installation of such the liquid supply device 200, the securing groove 163 and the outlet holes 164 and 172 may be formed in the dust collecting box cover 150.

If the dust collecting box cover 150 is configured of the external dust collecting box cover 160 and the inner dust collecting box cover 170 as mentioned above, the securing groove 163 and the first outlet hole 164 are provided in the external dust collecting box cover 160 and the second outlet hole 172 is provided in the internal dust collecting box cover 170.

The diameter of the end of the second guiding tube 212 may be substantially smaller than diameters of the other portions of the guiding tube 212 to exhaust the liquid material from the second guiding tube 212 in a spray type.

The other configurations are identical to corresponding ones of FIG. 3, except the above configuration, and description thereof will be omitted accordingly.

Figure 5:
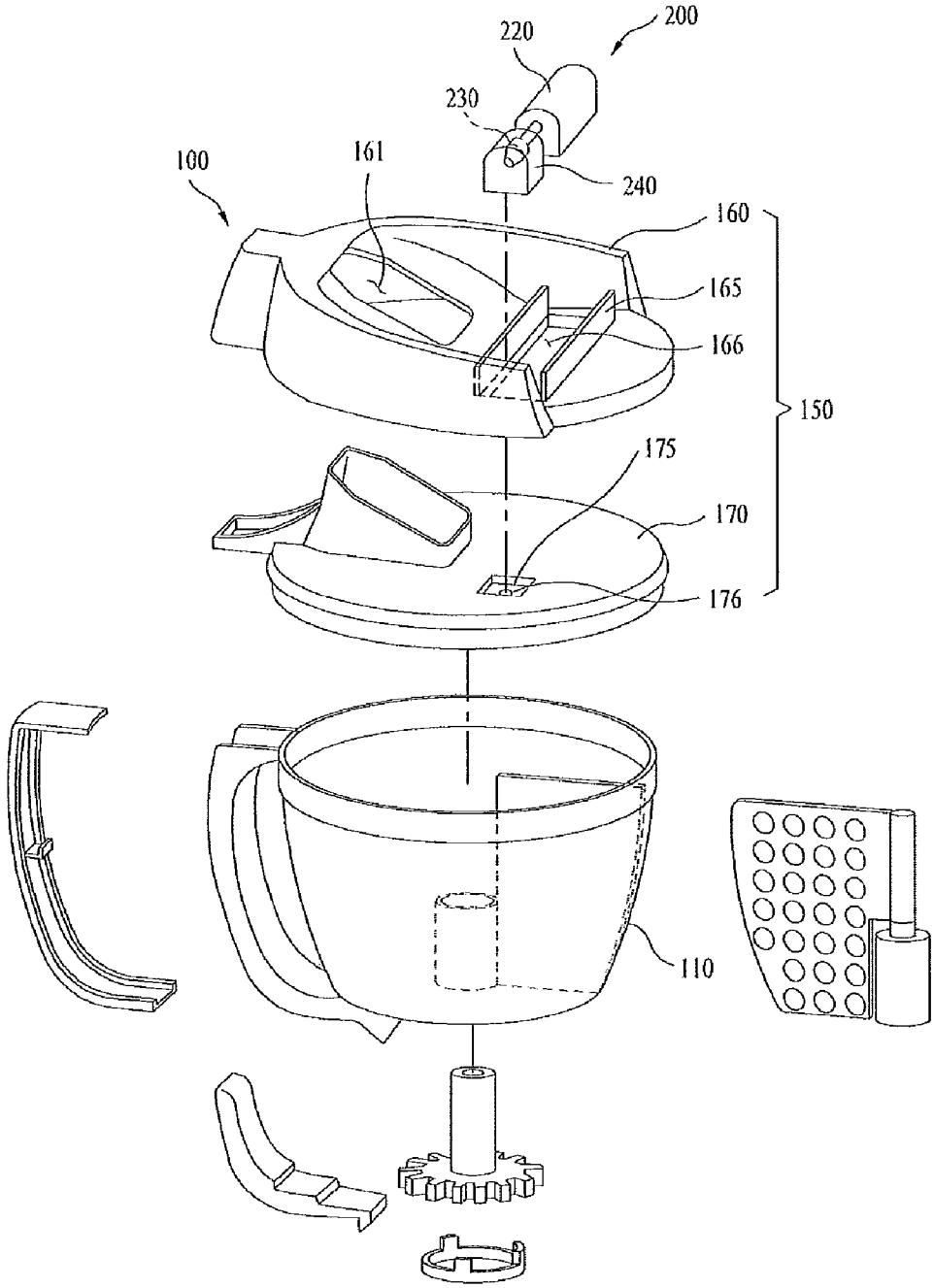

FIG. 5 illustrates another type of a liquid supply device provided on the top surface of the dust collecting box cover 150.

Here, the liquid supply device 200 may be configured of a spray device and such a spray device includes a storage tank 220 for storing the liquid material therein, a spraying part 230 connected to the storage tank 220 to spray the liquid material contained in the storage tank 220 and a spraying housing 240 coupled to the dust collecting box cover 150. Here, the spraying housing 240 accommodates the spraying part 230.

For the installation of the spray device, at least rib member 165 is formed on the external dust collecting box cover 160 and the rib member 165 supports side portions of the spray device and a securing groove 166 is formed between the rib members 165 to secure the spray device therein.

A coupling groove 175 is provided in the internal dust collecting box cover 170 and the spraying housing 240 is fixedly coupled to the coupling groove 175. An outlet hole 176 is formed in the coupling groove 175 and the liquid material sprayed from the spraying part 240 may be discharged into the dust collecting box 110.

A lower portion of the spraying housing 240 is open and a circumference of the open portion is inserted in the coupling groove 175 and the spraying part 230 is arranged adjacent to the outlet hole 176 such that the liquid material discharged from the spray device may be supplied to the dust collecting box 110 via the outlet hole 176.

Figure 6:
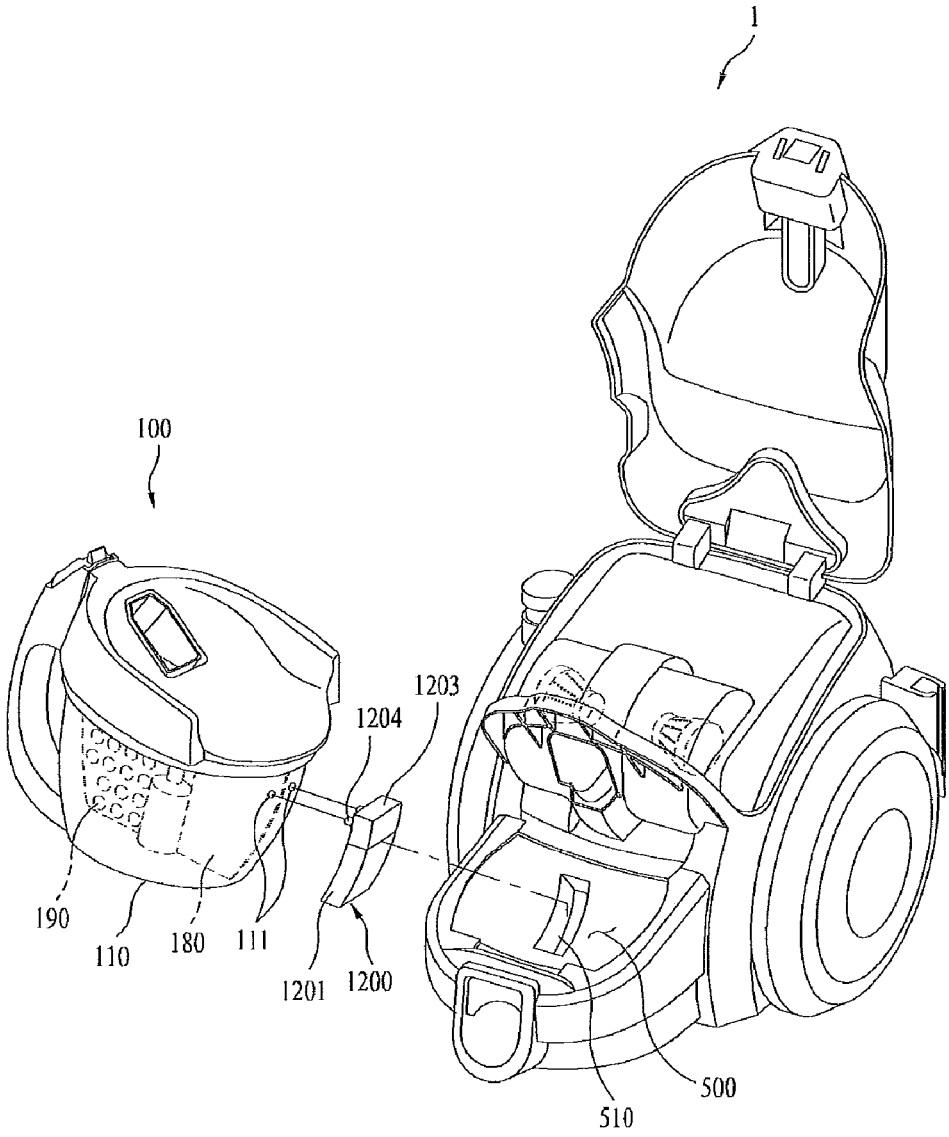
FIGS. 6 and 7 are perspective views illustrating a liquid supply device provided in the body of the vacuum cleaner.

FIG. 6 illustrates a liquid supply device 1200 installed in the body 1.

A securing groove 510 is provided in the dust collection device accommodating part 500 having a hemisphere shape to securely accommodate the liquid supply device 1200 therein.

The liquid supply device 1200 includes a storage part 1201 for storing the liquid material therein and an exhaustion pump 1203 connected to the storage part 1201, spraying the liquid material.

At least one outlet hole 111 is provided in a side wall of the dust collecting box 110 and a guiding tube 1204 extended from the exhaustion pump 1203 to guide the liquid material into the dust collecting box 110 may be coupled to the outlet hole 111.

The fixed plate 180 is provided in the dust collecting box 110 and the outlet holes 111 are arranged adjacent to a surface and the other surface of the fixed plate 180 such that the liquid material may be exhausted toward the pressed dust and other foreign substances collected near the surface and the other surface of the fixed plate 180.

Here also, the exhaustion pump 1203 may be an electric pump and it sprays the liquid material periodically during the operation of the vacuum cleaner.

Figure 7:
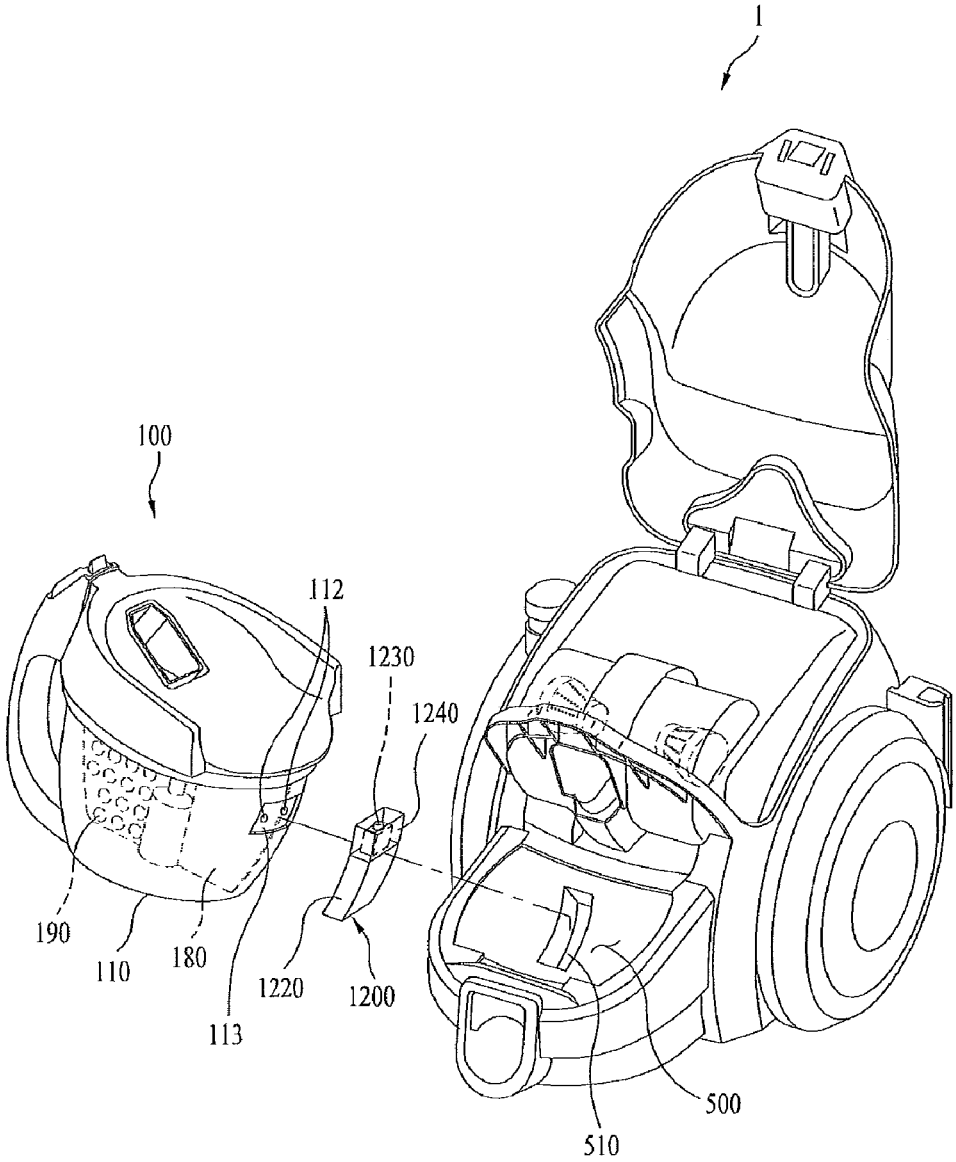

FIG. 7 illustrates the liquid supply device 1200 configured of a spray device.

The securing groove 510 is provided in the dust collection device accommodating part 500 to securely accommodate such the spray device.

The spray device detachably secured to the securing groove 510 includes a storage tank 1220 for storing the liquid material therein, a spraying part 1230 provided in the storage tank 1220 and a spraying housing 1240 surrounding the spraying part 1230, open toward the spraying direction of the spraying part 1230.

A coupling groove 113 is provided in a predetermined side wall of the dust collecting box 110 and a circumference of an open portion of the spraying housing 1240 is coupled to the coupling groove 113. At least one outlet hole 112 is provided in the coupling groove 113, arranged adjacent to the spraying part 1230.

The outlet holes 112 are provided adjacent to both surfaces of the fixed plate 180. The liquid material having passed the outlet 112 is sprayed to the dust and other foreign substances pressed and collected in a predetermined portion adjacent to the both surfaces of the fixed plate 180.

Here, the spraying part 1230 of the spray device is operated periodically when the vacuum cleaner is put into operation to spray the liquid material into the dust collecting box 110.

As follows, in reference to corresponding drawings, the operation of the vacuum cleaner according to the present invention will be described.

Figure 8:
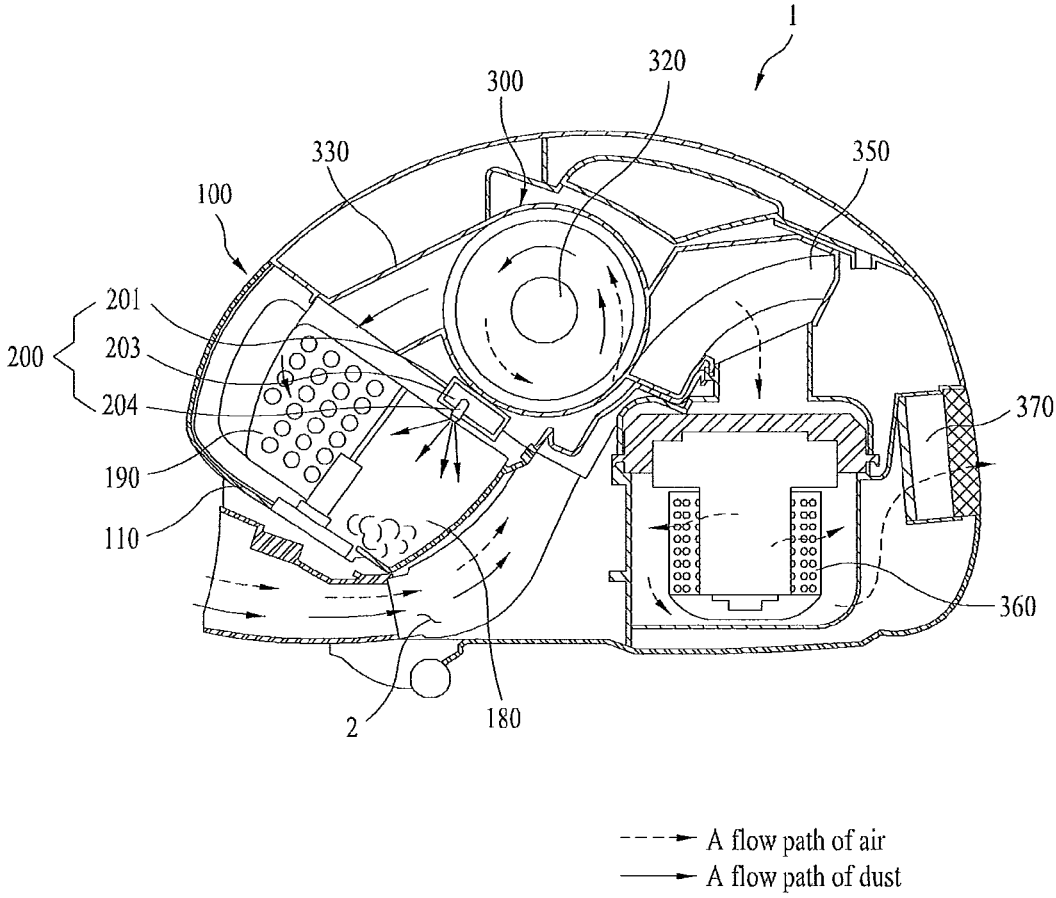
FIGS. 8 and 9 are side-sectional views illustrating operation of the vacuum cleaner according to the present invention.

As shown in FIG. 8, if the vacuum cleaner is put into operation, external air (referenced to as a dotted line) and dust and foreign substances (referenced to as a solid line) are sucked into the dust separation device 300 along the inlet path 2 provided in the body 1.

The dust and foreign substances sucked into the dust separation device 300 are moved along the inner circumferential surface of the dust separation device 300 by the centrifugal force and they are drawn into the dust collecting box 110 along the guide of the outlet part 330.

The air separated from the dust and foreign substances by the dust separation device 300 passes the air outlet member 320 and then it is filtered by the first filter unit 350. After that, the firstly filtered air passes the motor unit 350 and the second filter unit 370 only to be exhausted outside the body 1.

In the meanwhile, the liquid material is sprayed into the dust collecting box 110 from the liquid supply device 200 provided on the dust collection device 100 to fall toward the dust and other foreign substances.

The dust and other foreign substances dampened by the liquid material are collected to be a mass having a predetermined size and weight, because the liquid material has a predetermined viscosity.

Especially, if the liquid material is sprayed to the dust and other foreign substances pressed and collected near the fixed plate 180 by the rotation of the rotation plate 190, the dust and other foreign substances form a kind of mass such that the scattering of dust may be prevented.

As a result, when the user throws out the dust and other foreign substances collected in the dust collection device 100 after separating the dust collection device 100 from the body 1, the dust may not scattered and the dust mass may be separable from the dust collection device smoothly.

Here, if the liquid supply device 200 is configured of the storage part 201, the exhaustion pump 203 and the guiding tube 204 as mentioned in reference to FIG. 3, the liquid material is discharged into the dust collecting box along the guiding tube by the driving of the exhaustion pump 203.

If the liquid supply device is configured of the storage part 201 and the first, second and third guiding tubes 211, 212 and 213 as mentioned in reference to FIG. 4 difference between the pressures inside and outside the dust collecting box 110 is generated and external air is sucked into the dust collecting box 110 and the liquid material contained in the storage part 201 is sprayed into the dust collecting box 110 together with the air flow.

As the liquid supply device 200 is configured of the spray device as mentioned in reference to FIG. 5, the liquid material stored in the storage tank 220 is sprayed into the dust collecting box 110 by the operation of the spraying part 230 of the spray device.

Figure 9:
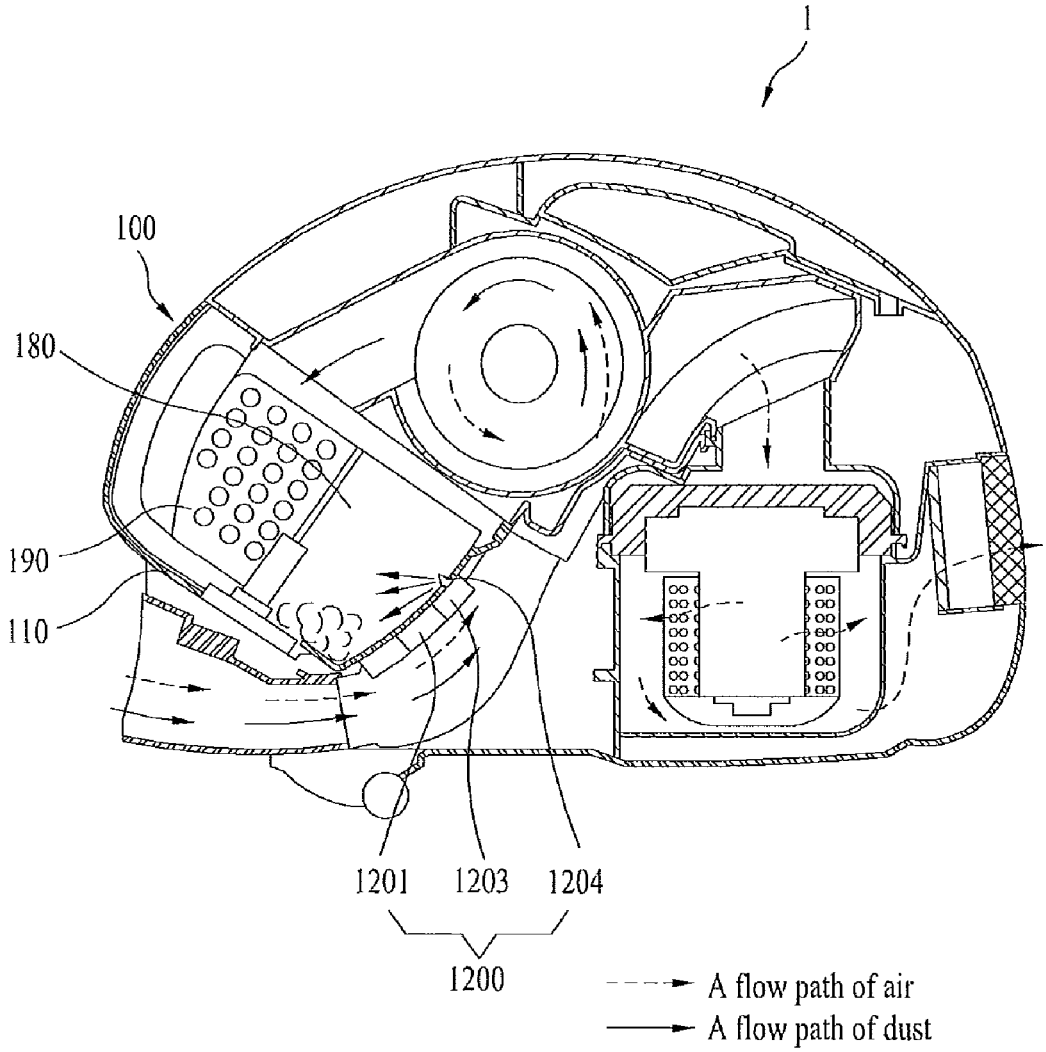

If the liquid supply device 1200 is located in a predetermined portion of the dust collection device 100 as shown in FIG. 9, the liquid material is sprayed from a side wall of the dust collecting box 110.

As mentioned above, the liquid supply device 1200 is installed adjacent to the fixed plate 180. Because of that, a more amount of liquid material may be sprayed to the dust and other foreign substances pressed and collected near the filed plate 180 by the rotation of the rotation plate 190.

The guiding tube 1204 of the exhaustion pump 1203 of the liquid supply device 1200 may be projected a predetermined distance toward the inside of the dust collecting box 110, passing through the size wall of the dust collecting box 110, and an end of the guiding tube 1204 may be arranged toward a lower surface of the dust collecting box 110.

This configuration is invented to make the liquid material fall toward the dust and other foreign substances smoothly.

FIG. 9 shows the liquid supply device configured of the storage part 1201 and the exhaustion pump 1203 as shown in FIG. 6 and an operational state shown in FIG. 9 may be commonly applicable to the spray device shown in FIG. 7.

The suction of the air and the dust and foreign substances, the separation of the air and the dust performed by the dust separation device, the path of the air flow and the path of the dust and other foreign substances are identical to those shown in FIG. 8 and detailed description thereof will be omitted accordingly.

Figure 10:
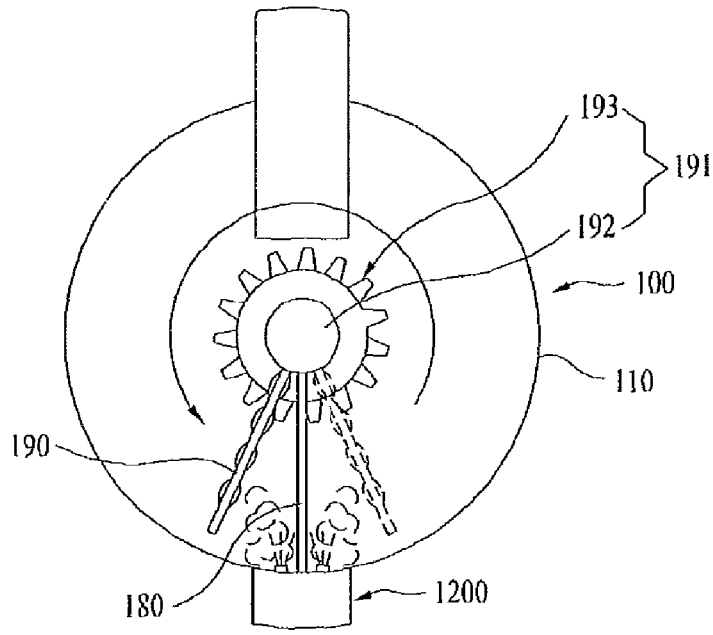
FIGS. 10 A and B are a plane view illustrating a dust collecting box collecting dust and other foreign substances and the liquid supply part put into operation.
Figure 10:
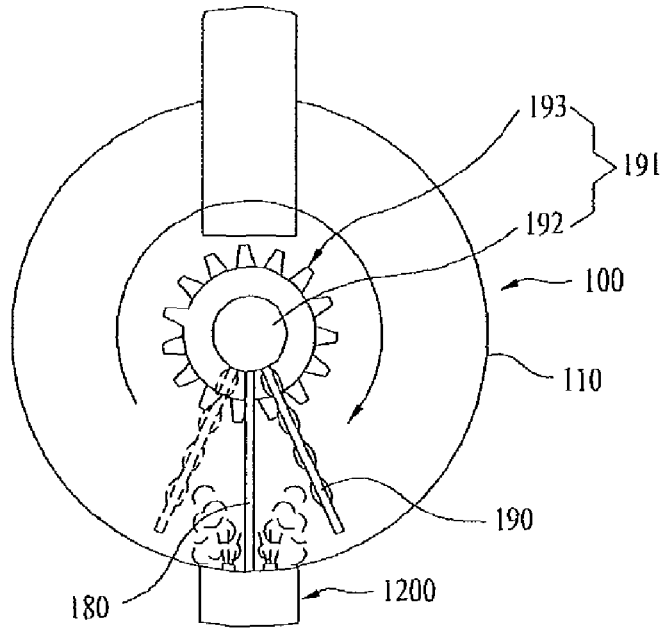

FIG. 10 shows that the liquid material is sprayed to dust and other foreign substances collected and pressed near the filed plate by the rotation of the rotation plate 190.

If the rotation plate 190 pushes the dust and the like collected in the dust collecting box toward a predetermined surface of the fixed plate 180, the dust and other foreign substances are compressed and filed up near the surface of the fixed plate 180, as shown in FIGS. 10A and 10B.

If it is determined that the rotation plate 190 is not rotated along the direction for pushing the dust any further, the driving motor (not shown) rotates the rotation plate 190 along an opposite direction.

Because of that, the rotation plate 190 is rotated toward the other surface of the fixed plate 180 and the dust and other foreign substances pushed by the rotation plate 190 are collected near the other surface of the fixed plate 180.

Hence, the liquid material exhausted from the liquid supply device 1200 is sprayed to the collected dust and other foreign substances such that the dust and other foreign substances mixed with the liquid material may be a mass.

Then, if such the liquid material is evaporated, the dust and other foreign substances may be a dry mass. As a result, the scattering of the dust inside the dust collecting box 110 may be prevented.

In addition, when the user throws out the dust after separating the dust collecting box 110 from the body 1, the mass is thrown out at once and the discharge of dust may be performed efficiently and conveniently only to solve the disadvantage of the conventional vacuum cleaners that dust and other foreign substances are scattered.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The present invention has following advantageous effects.

In case dust is collected in a dust collection device during the operation of the vacuum cleaner according to the present invention, liquid material having predetermined viscosity is exhausted from a liquid supply device.

As a result, the liquid material is mixed with the dust only to prevent the dust from being scattered inside the dust collection device.

Furthermore, in case a user separates the dust collection device from a body to clean after making the dust and other foreign substances mixed with the liquid material into a mass, the user may throw out the dust and other foreign substances in a single mass shape, without scattering. As a result, user convenience may be improved.

What is claimed is:

1. A vacuum cleaner comprising:

a body;

a dust collection device collecting dust and foreign substances therein;

a compression device provided in the dust collection device to collect the dust and foreign substances collected in a predetermined portion of the dust collection device, the compression device compressing the collected dust and foreign substances; and a liquid supply device provided in the dust collection device, in communication with an inside of the dust collection device, to supply liquid material to the dust collection device.

2. The vacuum cleaner as claimed in claim 1, wherein the dust collection device comprises, a dust collecting box collecting the dust and foreign substances therein; and a dust collecting box cover covering the dust collecting box closably, and the liquid supply device is detachably arranged in the dust collecting box cover.

3. The vacuum cleaner as claimed in claim 2, wherein the liquid supply device comprises, a storage part storing predetermined liquid material therein; and a guiding member guiding the liquid material into the dust collecting box by making the storage part in communication with the dust collecting box.

4. The vacuum cleaner as claimed in claim 3, wherein the guiding member comprises, an exhaustion pump connected to the storage to exhaust the liquid material to the storage part; and a guiding tube having an end connected to the exhaustion pump and the other end passing through the dust collecting box cover toward the dust collecting box to guide the liquid material exhausted by the exhaustion pump into the dust collecting box.

5. The vacuum cleaner as claimed in claim 3, wherein the guiding member comprises a guiding tube connected to the storage part to guide the liquid material stored in the storage part into the dust collecting box and the guiding tube comprises, a first guiding tube connected to the storage part;

a second guiding tube connected to the first guiding tube, with an end passing through the dust collecting box cover; and a third guiding tube connected to both of the first and second guiding tubes to suck external air into the dust collecting box in case the pressure inside the dust collecting box is substantially lower than the atmosphere pressure.

6. The vacuum cleaner as claimed in claim 5, wherein in case the pressure inside the dust collecting box is lower than the atmosphere pressure, the first, second and third guiding tubes are in communication with each other for the liquid material stored in the storage part to be sucked into the dust collecting box together with air by gradients of the pressure inside the third guiding tube and the pressure inside the storage part formed by flow of air sucked into the dust collecting box along the guide of the third guiding tube.

7. The vacuum cleaner as claimed in claim 4, wherein a diameter of a portion of the guiding tube toward the inside of the dust collecting box is getting smaller gradually toward the end of the guiding tube to spray the liquid material from the guiding tube.

8. The vacuum cleaner as claimed in claim 2, wherein the liquid supply device is configured of a spray device and the liquid supply device comprises, a storage tank storing liquid material therein;

a spraying part connected to the storage tank, the spraying part secured to an outlet hole formed in the dust collecting box cover; and a spraying housing coupled to the dust collecting box cover to secure the spraying part to the outlet hole, the spraying housing accommodating the spraying part.

9. The vacuum cleaner as claimed in claim 2, further comprising:

a securing groove provided in the dust collecting box cover to secure the liquid supply device therein in case the liquid supply device is secured to the dust collecting box cover.

10. The vacuum cleaner as claimed in claim 2 wherein the compression device comprises, a fixed plate extended upward from a lower surface of the dust collecting box; and a rotating plate rotatably provided in the dust collecting box, contactable with the fixed plate to collect the dust and foreign substances by using the rotation thereof and to compress the collected dust and foreign substances in the dust collecting box.

* * * * *